United States Patent [19]

Folkins

[11] Patent Number: 5,034,775

[45] Date of Patent: Jul. 23, 1991

[54] TRIBOELECTRIC CHARGE MEASUREMENT

[75] Inventor: Jeffrey J. Folkins, Rochester, N.Y.

[73] Assignee: Xerox Corporation, Stamford, Conn.

[21] Appl. No.: 484,602

[22] Filed: Feb. 26, 1990

[51] Int. Cl.[5] ..... G03G 15/06

[52] U.S. Cl. ..... 355/259; 118/653; 118/688; 355/246; 430/120

[58] Field of Search ..... 355/259, 245, 246, 265, 355/261, 251, 253, 202; 430/120, 122; 118/653, 656, 657, 658, 659, 661, 688

[56] References Cited

U.S. PATENT DOCUMENTS

| | | | |
|---|---|---|---|
| 4,319,544 | 3/1982 | Weber | 118/647 |
| 4,492,179 | 1/1985 | Folkins et al. | 355/246 X |
| 4,538,897 | 9/1985 | Osaka et al. | 355/246 |
| 4,643,561 | 2/1987 | Folkins . | |
| 4,686,934 | 8/1987 | Kohyama | 118/658 X |
| 4,833,500 | 5/1989 | Mochizuki | 355/256 |

FOREIGN PATENT DOCUMENTS

| | | | |
|---|---|---|---|
| 0119049 | 10/1978 | Japan | 118/657 |
| 0068758 | 4/1983 | Japan | 355/253 |

*Primary Examiner*—A. T. Grimley
*Assistant Examiner*—Thu A. Dang
*Attorney, Agent, or Firm*—H. Fleischer; J. E. Beck; R. Zibelli

[57] ABSTRACT

An apparatus in which the triboelectric charge of developer material toner adhering to carrier is measured. In the development system, a magnetic roller transports developer material closely adjacent a donor roller. The donor roller is electrically biased relative to the magnetic roller so that toner is developed onto the donor roller. The instantaneous current flow electrically biasing the donor roller is integrated and is indicative of the triboelectric charge to the developer material.

16 Claims, 3 Drawing Sheets

TRIBOELECTRIC CHARGE MEASUREMENT

This invention relates generally to a development apparatus used an electrophotographic printing machine, and more particularly concerns measuring the triboelectric charge of developer material having toner adhering to carrier.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer material into contact therewith. Two component and single component developer materials are commonly used. A typical two component developer material comprises magnetic carrier granules having toner particles adhering triboelectrically thereto. A single component developer material typically comprises toner particles. Toner particles are attracted to the latent image forming a toner powder image on the photoconductive surface. The toner powder image is subsequently transferred to a copy sheet. Finally, the toner powder image is heated to permanently fuse it to the copy sheet in image configuration.

Single component development systems use a donor roll for transporting charged toner to the development nip defined by the donor roll and photoconductive member. The toner is developed on the latent image recorded on the photoconductive member by a combination of mechanical and/or electrical forces. Scavengeless development and jumping development are two types of single component development. A scavengeless development system uses a donor roll with a plurality of electrode wires closely spaced therefrom in the development zone. An AC voltage is applied to the wires forming a toner cloud in the development zone. The electrostatic fields generated by the latent image attract toner from the toner cloud to develop the latent image. In jumping development, an AC voltage is applied to the donor roller detaching toner from the donor roll and projecting the toner toward the photoconductive member so that the electrostatic fields generated by the latent image attract the toner to develop the latent image. Single component development systems appear to offer advantages in low cost and design simplicity. However, the achievement of high reliability and easy manufacturability of the system may be present a problem. Two component development systems have been used extensively in many different types of printing machines. A two component development system usually employs a magnetic brush developer roller for transporting carrier having toner adhering triboelectrically thereto. The electrostatic fields generated by the latent image attract the toner from the carrier so as to develop the latent image. In high speed commercial printing machines, a two component development system may have lower operating costs than a single component development system. Clearly, two component development systems and single component development systems each have their own advantages. Accordingly, it is desirable to combine these systems to form a hybrid development system having the desirable features of each system. For example, at the 2nd International Congress on Advances in Non-impact Printing held in Washington, D.C. on Nov. 4–8, 1984, sponsored by the Society for Photographic Scientists and Engineers, Toshiba described a development system using a donor roll and a magnetic roller. The donor roll and magnetic roller were electrically biased. The magnetic roller transported a two component developer material to the nip defined by the donor roll and magnetic roller. Toner is attracted to the donor roll from the magnetic roll. The donor roll is rotated synchronously with the photoconductive drum with the gap therebetween being about 0.20 millimeters. The large difference in potential between the donor roll and latent image recorded on the photoconductive drum causes the toner to jump across the gap from the donor roll to the latent image so as to develop the latent image. Frequently, the characteristics of the developer material change. As the toner is developed on the latent image, toner is depleted from the developer material and the toner concentration decreases. In order to achieve satisfactory development, the concentration of toner within the developer material must be controlled within reasonable limits. This requires the toner concentration/triboelectric characteristics of the developer material to be measured and controlled. Typically, a test patch is developed with toner and the density of the developed test patch measured and compared to a reference to generate an error signal. The error signal is used to control the toner concentration of the developer material. However, the technique of developing a test patch and comparing the measured density to a reference for generating an error signal has been found to be ineffective for hybrid development systems. Thus, it is necessary to devise a technique for controlling the triboelectric charge of the developer material used in a hybrid development system. Various other types of control schemes have been devised. The following disclosures appear to be relevant:

- U.S. Pat. No. 4,319,544, patentee: Weber, issued: Mar. 16, 1982.
- U.S. Pat. No. 4,643,561, patentee: Folkins, issued: Feb. 17, 1987.
- U.S. Pat. No. 4,833,500, patentee: Mochizuki et al., issued: Mar. 23, 1989.

The relevant portions of the foregoing patents may be briefly summarized as follows:

U.S. Pat. No. 4,319,544 discloses digitally biasing an electrode closely spaced from a photoconductive surface. The instantaneous electric potential value of the bias is changed with time in proportion to the natural decay of the resident electric charge inherent in the photoconductive surface.

U.S. Pat. No. 4,643,561 describes a printing machine having a development system which uses a charging roller for charging the toner on a developer roller. The charging roller and the developer roller are electrically biased. The current biasing the charging roller and the current biasing the developer roller is summed and a signal indicative of the electrical potential of the photoconductive surface generated. This signal may be used to control the various processing stations within the printing machine.

U.S. Pat. No. 4,833,500 discloses developer rollers electrically biased by DC power supplies. In one embodiment, the potential of the developer rollers is limited to a level intermediate predetermined upper and lower limits. The developing rollers are switched into an electrically floating condition except during development of an image. In another embodiment, a developing bias potential is produced responsive to the developing rollers which are then used as developing electrodes.

In accordance with one aspect of the present invention, there is provided an apparatus for measuring triboelectric charge of developer material having toner adhering to carrier. The apparatus includes a housing defining a chamber storing a supply of the developer material therein. A donor member is disposed, at least partially, in the chamber of the housing. Means are provided for transporting developer material to a region adjacent the donor member. Means electrically bias the donor member and the transporting means relative to one another so as to deposit toner on the donor member. Means detect the current biasing the donor member and the transporting means relative to one another and transmit a signal in response thereto corresponding to the triboelectric charge of the developer material.

Pursuant to another aspect of the present invention, there is provided an electrophotographic printing machine of the type in which an electrostatic latent image recorded on a photoconductive member is developed to form a visible image thereof. The improvement includes a housing defining a chamber storing a supply of developer material comprising at least carrier and toner. A donor member is spaced from the photoconductive member and adapted to transport toner to a region opposed from the photoconductive member. Means transport developer material to a region adjacent the donor member. Means are provided for electrically biasing the donor member and the transporting means relative to one another so as to deposit toner on the donor member. Means detect the current biasing the donor member and the transporting means relative to one another and transmitting a signal in response thereto corresponding to the triboelectric charge of the developer material.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
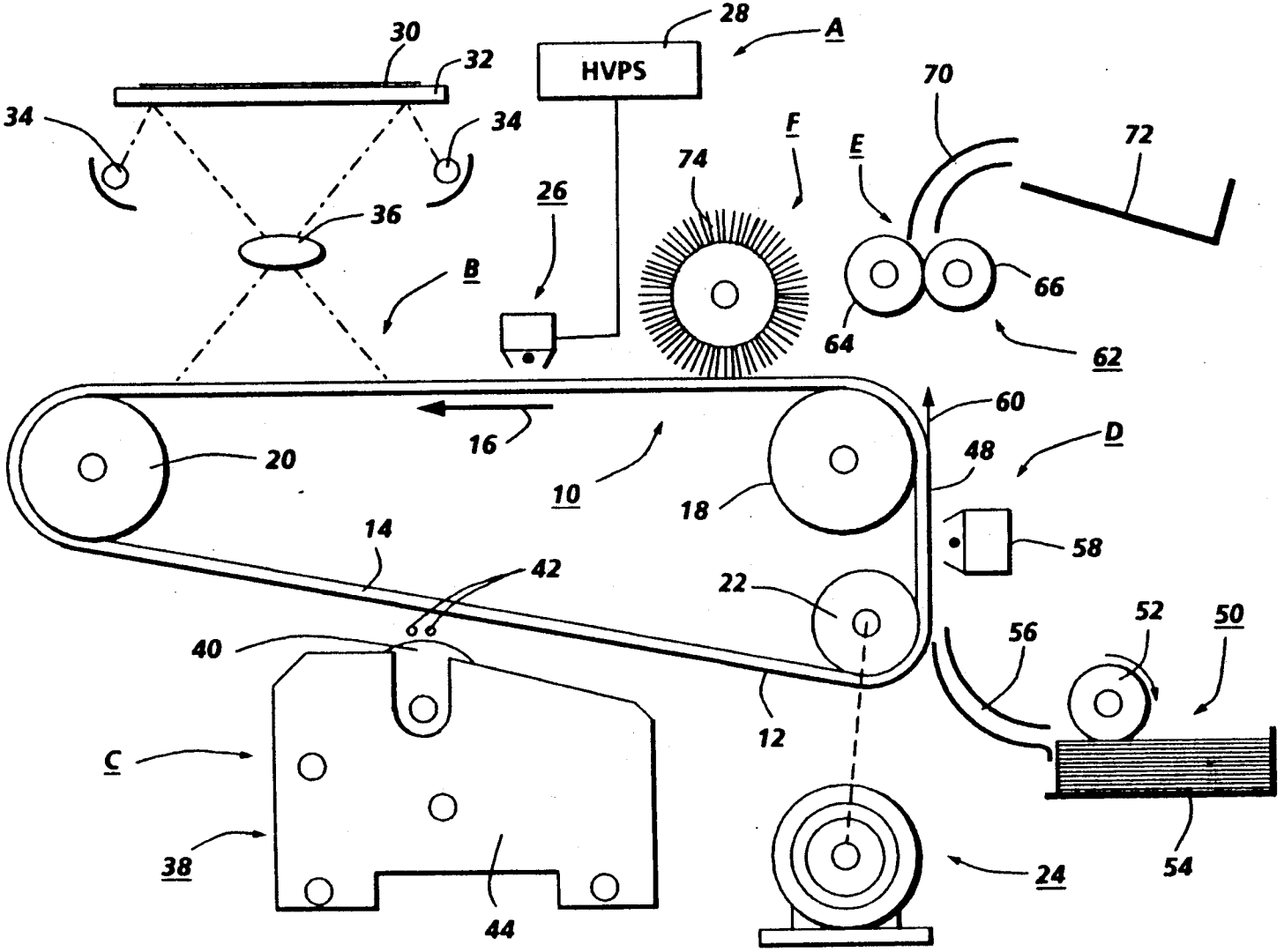
FIG. 1 is a schematic elevational view of an illustrative electrophotographic printing machine incorporating a development apparatus having the features of the present invention therein.

Referring initially to FIG. 1, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a development system, indicated generally by the reference numeral 38, develops the latent image recorded on the photoconductive surface. Preferably, development system 38 includes donor roller 40 and electrode wires 42. Electrode wires 42 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor rollers 40 is mounted, at least partially, in the chamber of developer housing 44. The chamber in developer housing 44 stores a supply of developer material. The developer material is a two component developer material of at least carrier granules having toner particles adhering triboelectrically thereto. A magnetic roller disposed interiorly of the chamber of housing 44 conveys the developer material to the donor roller. The magnetic roller is electrically biased relative to the donor roller so that the toner particles are attracted from the magnetic roller to the donor roller. The triboelectric charge of the developer material is measured when the development system is inactive, i.e. when the latent image is not being developed. The development apparatus will be discussed hereinafter, in greater detail, with reference to FIG. 2.

With continued reference to FIG. 1, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 60 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 2:
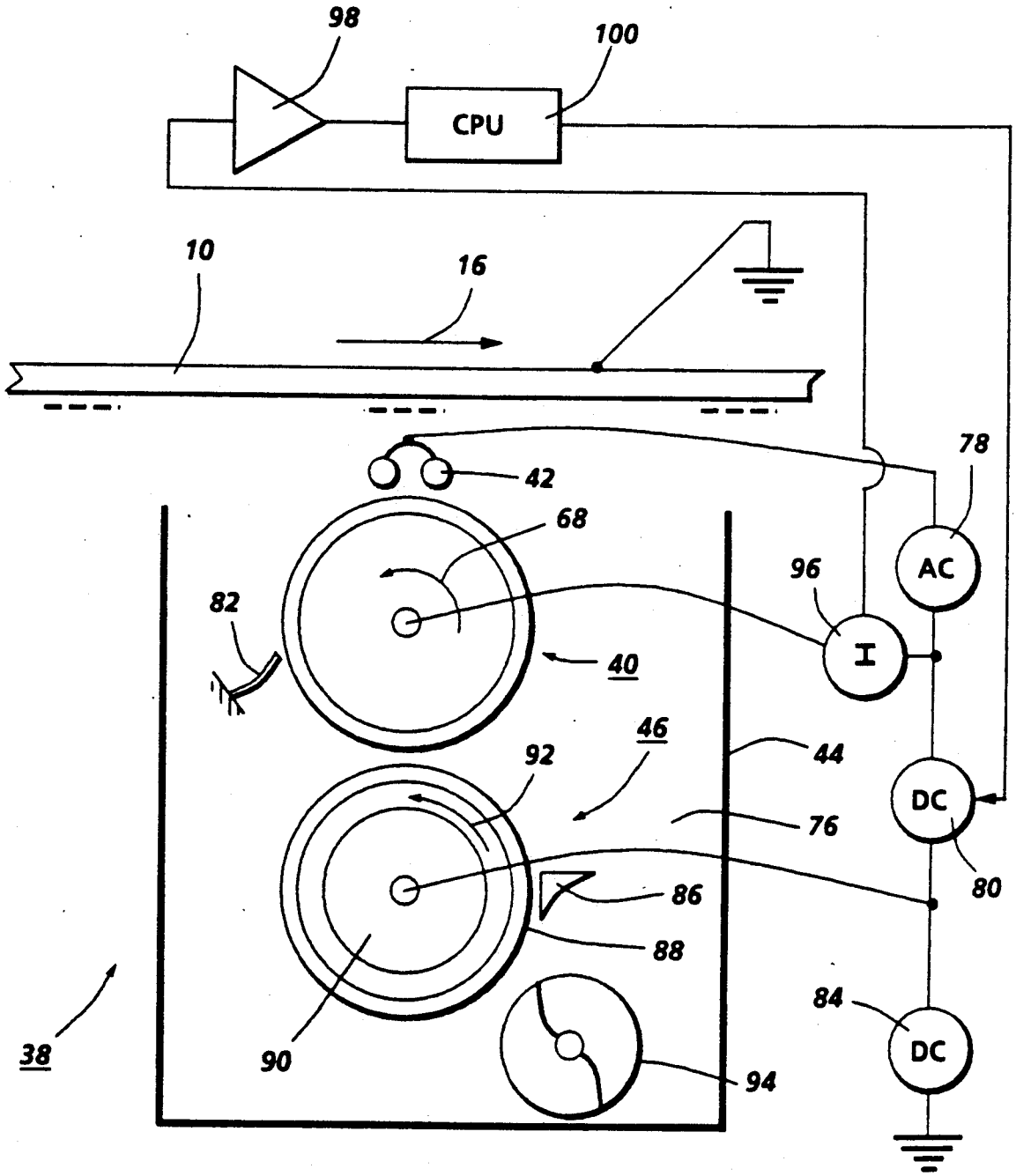
FIG. 2 is a schematic elevational view showing the development apparatus used in the FIG. 1 printing machine.
Figure 3:
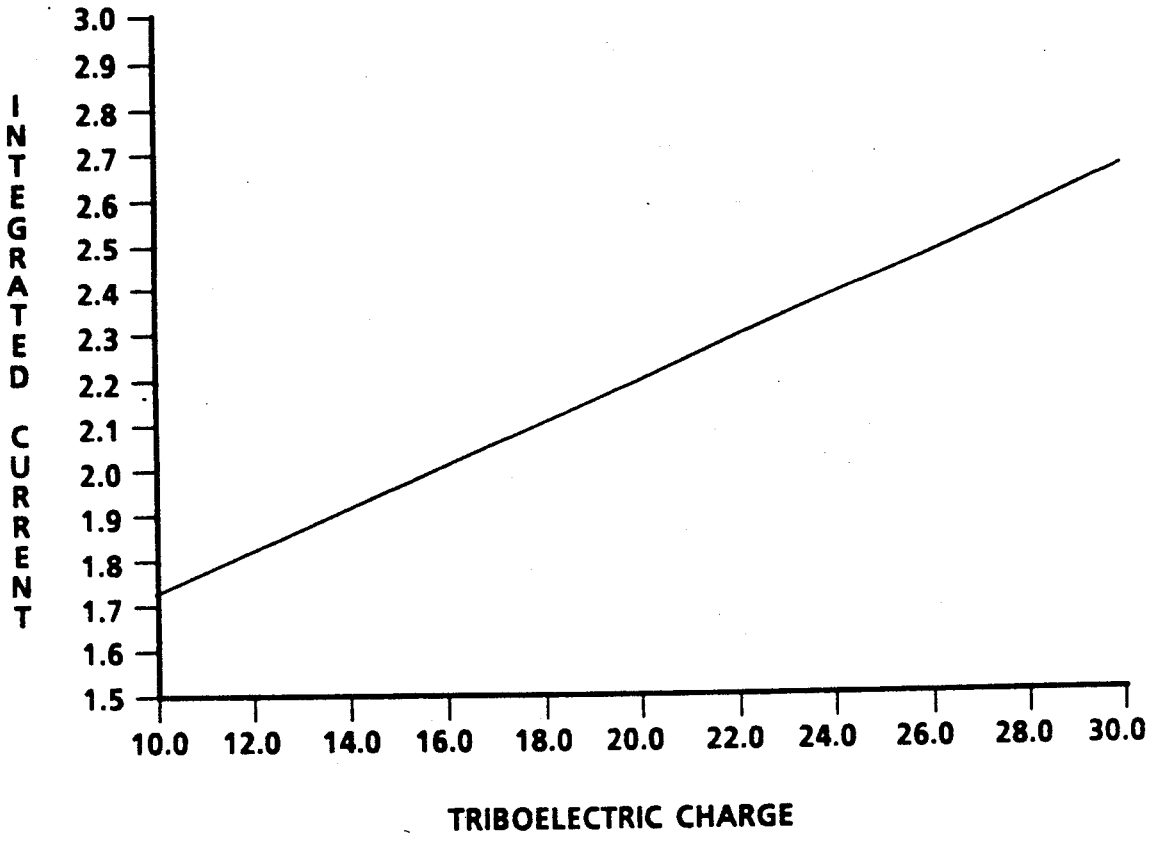
FIG. 3 is a graph of the control signal plotted as a function of the developer material triboelectric charge.

Referring now to FIG. 2, there is shown development system 38 in greater detail. As shown thereat, development system 38 includes a housing 44 defining a chamber 76 for storing a supply of developer material therein. Donor roller 40, electrode wires 42 and magnetic roller 46 are mounted in chamber 76 of housing 44. The donor roller can be rotated in either the 'with' or 'against' direction relative to the direction of motion of belt 10. In FIG. 2, donor roller 40 is shown rotating in the direction of arrow 68, i.e. the against direction. Similarly, the magnetic roller can be rotated in either the 'with' or 'against' direction relative to the direction of motion of belt 10. In FIG. 2, magnetic roller 46 is shown rotating in the direction of arrow 92 i.e. the against direction. Donor roller 4 is preferably made from anodized aluminum.

Development system 38 also has electrode wires 42 which are disposed in the space between the belt 10 and donor roller 40. A pair of electrode wires are shown extending in a direction substantially parallel to the longitudinal axis of the donor roller. The electrode wires are made from of one or more thin (i.e. 50 to 100$\mu$ diameter) tungsten wires which are closely spaced from donor roller 40. The distance between the wires and the donor roller is approximately 25$\mu$ or the thickness of the toner layer on the donor roll. The wires are self-spaced from the donor roller by the thickness of the toner on the donor roller. To this end the extremities of the wires supported by the tops of end bearing blocks also support the donor roller for rotation. The wire extremities are attached so that they are slightly below a tangent to the surface, including toner layer, of the donor structure. Mounting the wires in such a manner makes them insensitive to roll runout due to their self-spacing.

As illustrated in FIG. 2, an alternating electrical bias is applied to the electrode wires by an AC voltage source 78. The applied AC establishes an alternating electrostatic field between the wires and the donor roller which is effective in detaching toner from the surface of the donor roller and forming a toner cloud about the wires, the height of the cloud being such as not to be substantially in contact with the belt 10. The magnitude of the AC voltage is relatively low and is in the order of 200 to 500 volts peak at a frequency ranging from about 3 kHz to about 10 kHz. A DC bias supply 80 which applies approximately 300 volts to donor roller 40 establishes an electrostatic field between photoconductive surface 12 of belt 10 and donor roller 40 for attracting the detached toner particles from the cloud surrounding the wires to the latent image recorded on the photoconductive surface. At a spacing ranging from about 10$\mu$ to about 40$\mu$ between the electrode wires and donor roller, an applied voltage of 200 to 500 volts produces a relatively large electrostatic field without risk of air breakdown. The use of a dielectric coating on either the electrode wires or donor roller helps to prevent shorting of the applied AC voltage. A cleaning blade 82 strips all of the toner from donor roller 40 after development so that magnetic roller 46 meters fresh toner to a clean donor roller. Magnetic roller 46 meters a constant quantity of toner having a substantially constant charge on to donor roller 40. This insures that the donor roller provides a constant amount of toner having a substantially constant charge in the development gap. In lieu of using a cleaning blade, the combination of donor roller spacing, i.e. spacing between the donor roller and the magnetic roller, the compressed pile height of the developer material on the magnetic roller, and the magnetic properties of the magnetic roller in conjunction with the use of a conductive, magnetic developer material achieves the deposition of a constant quantity of toner having a substantially constant charge on the donor roller. A DC bias supply 84 which applies approximately 100 volts to magnetic roller 46 establishes an electrostatic field between magnetic roller 46 and donor roller 40 so that an electrostatic field is established between the donor roller and the magnetic roller which causes toner particles to be attracted from the magnetic roller to the donor roller. Metering blade 86 is positioned closely adjacent to magnetic roller 46 to maintain the compressed pile height of the developer material on magnetic roller 46 at the desired level. Magnetic roller 46 includes a non-magnetic tubular member 88 made preferably from aluminum and having the exterior circumferential surface thereof roughened. An elongated magnet 90 is positioned interiorly of and spaced from the tubular member. The magnet is mounted stationarily. The tubular member rotates in the direction of arrow 92 to advance the developer material adhering thereto into the nip defined by donor roller 40 and magnetic roller 46. Toner particles are attracted from the carrier granules on the magnetic roller to the donor roller.

With continued reference to FIG. 2, augers, indicated generally by the reference numeral 94, are located in chamber 76 of housing 44. Augers 94 are mounted rotatably in chamber 76 to mix and transport developer material. The augers have blades extending spirally outwardly from a shaft. The blades are designed to advance the developer material in the axial direction substantially parallel to the longitudinal axis of the shaft.

As successive electrostatic latent images are developed, the toner particles within the developer material are depleted. A toner dispenser (not shown) stores a supply of toner particles. The toner dispenser is in communication with chamber 76 of housing 44 As the concentration of toner particles to carrier granules decreases, the triboelectric charge of the developer material typically increases, and fresh toner particles are furnished to the developer material in the chamber from the toner dispenser. The augers in the chamber of the housing mix the fresh toner particles with the remaining developer material so that the triboelectric charge of the developer material is optimized. In this way, a substantially constant amount of toner particles are in the chamber of the developer housing with the toner particles having a constant charge. The developer material in the chamber of the developer housing is magnetic and may be electrically conductive. By way of example, the carrier granules include a ferromagnetic core having a thin layer of magnetite overcoated with a non-continuous layer of resinous material. The toner particles are made from a resinous material, such as a vinyl polymer, mixed with a coloring material, such as chromogen black. The developer material comprise from about 95% to about 99% by weight of carrier and from 5% to about 1% by weight of toner. However, one skilled in the art will recognize that any suitable developer material having at least carrier granules and toner particles may be used.

The triboelectric charge of the developer material is monitored when the development system is inactivated and the latent image is not being developed. A current sensor 96 measures the instantaneous current flow electrically biasing donor roller 40. Current sensor 96 develops an electrical output signal indicative of the current electrically biasing donor roller 40. One skilled in the art will appreciate that in lieu of measuring the current electrically biasing donor roller 40, the current electrically biasing magnetic roller 46 may be measured. In either case, the the signal from the current detector is integrated by amplifier 98 and the circuitry associated therewith (not shown). The integrated signal is transmitted to centralized processing unit (CPU) 100. CPU 100 compares the integrated signal to a reference and generates a control signal which may be used to regulate the various processing stations within the printing machine. For example, the control signal may be used to regulate the dispensing of toner particles into the developer material in the developer housing. In addition, the control signal may be used to regulate charging, exposure, etc.. CPU 100 also varies the voltage source 80 to vary the the voltage electrically biasing donor roller 40. In this way, the current detector 96 measures the instantaneous current flow into the donor roller 40 after the donor roller to magnetic roller voltage, $V_{dnr-mag}$, change. The current electrically biasing the donor roller is integrated for several revolutions of the donor roller to obtain the total charge transfer. Under certain conditions, this signal is proportional to the triboelectric charge of the toner. Similarly, there are conditions where the instantaneous current flow value measured at a certain time after the voltage change is proportional to the triboelectric charge.

After either one pass on the donor roller with a 100% loading neutralization, or multiple passes of a less efficient magnetic roller loading the donor roller, the toner developed onto the donor roller from the magnetic roller should be developed to neutralization relative to the donor roller to magnetic roller voltage, $V_{dnr-mag}$. Under these circumstances, when a non-contact electrostatic voltmeter is located over the surface of the donor roller after development, the voltmeter will read exactly the donor roller to magnetic roller voltage, $V_{dnr-mag}$, relative to donor roller voltage bias. Hence, after neutralization, $$ESV_{dnr} - V_{donor} = V_{dnr-mag}$$

where:

$ESV_{dnr}$ is the measured voltage of the donor roller; and $V_{donor}$ is the donor roller bias voltage.

From electrostatic theory:

$$ESV_{dnr} - V_{donor} = (d/\epsilon)_{ave}(Q/A)_{ave}$$

where:

$(d/\epsilon)_{ave}$=average toner dielectric thickness; and $(Q/A)_{ave}$=average toner charge/area.

For a specified size distribution of toner, the mass/area, M/A, of the toner on the donor roller is proportional to the average thickness of the toner dielectric thickness, $(d/\epsilon)_{ave}$. Thus, $$M/A = C(d/\epsilon)_{ave}$$

where: C=a geometric constant dependent on the toner size and density distribution.

The change in toner charge, δQ, resulting from additional developed toner charge may be measured by integrating the current flowing to the donor roller after a voltage change, $\delta V_{dnr-mag}$. Combining this with the previous relationship defines δQ as $$\delta Q = \delta V_{dnr-mag} A/(d/\epsilon)_{ave} = \delta V_{dnr-mag} A^2 C/\delta M$$

Since $\delta V_{dnr-mag} A^2 C$ is a known constant, the integrated value of δQ is inversely proportional to the change in donor roller mass, δM. Since $$\text{Toner triboelectric charge} = Q/M$$

Then the $$\text{Toner triboelectric charge} = \delta Q^2/(\delta V_{dnr-mag} A^2 C)$$

or the integrated value of δQ is proportional to the square root of the toner triboelectric charge.

It is thus clear that the current measurement theoretically responds only triboelectric charge and not to toner concentration.

FIG. 2 shows measurements of the toner triboelectric charge and the integrated current measured by current sensor 78 after several donor roller revolutions. The graph shows a linear relationship between the triboelectric charge and the integrated current.

One skilled in the art will appreciate that the foregoing technique for measuring and controlling the triboelectric charge may be used in various other types of development systems such an AC jumping development system, where the developer roll contacts the photoreceptor as used in Canon printing machines, and a skid development system, used in Ricoh printing machines.

In recapitulation, it is evident that the integrated instantaneous current flow electrically biasing a donor roller or a magnetic roller in a hybrid development apparatus of the type described herein is a measurement of the triboelectric charge of the toner used therein.

It is, therefore, apparent that there has been provided in accordance with the present invention, an apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for measuring triboelectric charge of developer material having toner adhering to carrier, including:

a housing defining a chamber storing a supply of the developer material therein;

a donor member disposed, at least partially in the chamber of said housing;

means for transporting developer material to a region adjacent said donor member;

means for electrically biasing said donor member and said transporting means relative to one another so as to deposit toner on said donor member;

means for detecting a current biasing said donor member and said transporting means relative to one another and transmitting a signal in response thereto corresponding to the triboelectric charge of the developer material; and means, responsive to the signal from said detecting and transmitting means, for controlling said electrical biasing means.

2. An apparatus according to claim 1, wherein said detecting and transmitting means includes means for integrating the current biasing said donor member and said transporting means relative to one another.

3. An apparatus according to claim 1, further including an electrode member positioned adjacent said donor member in a region thereof opposed from said transporting means, said electrode member being closely spaced from said donor member and being adapted to be electrically biased to detach toner from said donor member to form a toner cloud in the space.

4. An apparatus according to claim 3, wherein the developer material is magnetic.

5. An apparatus according to claim 4, wherein said transporting means includes means for attracting magnetically developer material from the supply thereof in the chamber of said housing to the exterior surface thereof.

6. An apparatus according to claim 5, wherein said attracting means includes:

a non-magnetic tubular member mounted rotatably so as to advance developer material from the chamber of said housing to said donor member; and an elongated magnetic member disposed interiorly of said tubular member for attracting developer material to the surface of said tubular member.

7. An apparatus according to claim 5, wherein said donor member includes a roll.

8. An apparatus according to claim 6, wherein said electrode member includes a plurality of small diameter wires.

9. An electrophotographic printing machine of the type in which an electrostatic latent image recorded on a photoconductive member is developed to form a visible image thereof, wherein the improvement includes:

a housing defining a chamber storing a supply of developer material comprising at least carrier and toner;

a donor member spaced from the photoconductive member and being adapted to transport toner to a region opposed from the photoconductive member;

means for transporting developer material to a region adjacent said donor member;

means for electrically biasing said donor member and said transporting means relative to one another so as to deposit toner on said donor member;

means for detecting a current biasing said donor member and said transporting means relative to one another and transmitting a signal in response thereto corresponding to the triboelectric charge of the developer material; and means, responsive to the signal from said detecting and transmitting means, for controlling said electrical biasing means.

10. A printing machine according to claim 9, wherein said detecting and transmitting means includes means for integrating the current biasing said donor member and said transporting means relative to one another.

11. A printing machine according to claim 9, further including an electrode member positioned adjacent said donor member in the region thereof opposed from the photoconductive member, said electrode member being closely spaced from said donor member and being adapted to be electrically biased to detach toner from said donor member to form a toner cloud in the space.

12. A printing machine according to claim 11, wherein the developer material in the chamber of said housing is magnetic.

13. A printing machine according to claim 12, wherein said transporting means includes means for attracting magnetically developer material from the supply thereof in the chamber of said housing to the exterior surface thereof.

14. A printing machine according to claim 13, wherein said attracting means includes:

a non-magnetic tubular member mounted rotatably so as to advance developer material from the chamber of said housing to said donor member; and an elongated magnetic member disposed interiorly of said tubular member for attracting developer material to the surface of said tubular member.

15. A printing machine according to claim 14, wherein said donor member includes a roll.

16. A printing machine according to claim 15, wherein said electrode member includes a plurality of small diameter wires.

* * * * *